US012546123B2

(12) United States Patent
Maritano

(10) Patent No.: US 12,546,123 B2
(45) **Date of Patent: *Feb. 10, 2026**

(54) ELEMENT OF DAMPING LAYER FOR FLOORING AND RELATED DAMPING LAYER

(71) Applicant: POLYGREEN S.R.L., Desenzano del Garda (IT)

(72) Inventor: Riccardo Maritano, Desenzano del Garda (IT)

(73) Assignee: POLYGREEN S.R.L., Desenzano del Garda (IT)

( * ) Notice: Subject to any disclaimer, the term of this patent is extended or adjusted under 35 U.S.C. 154(b) by 146 days.

This patent is subject to a terminal disclaimer.

(21) Appl. No.: 18/264,807

(22) PCT Filed: Feb. 9, 2022

(86) PCT No.: PCT/IT2022/050025

§ 371 (c)(1),
(2) Date: Aug. 9, 2023

(87) PCT Pub. No.: WO2022/172309

PCT Pub. Date: Aug. 18, 2022

(65) Prior Publication Data

US 2024/0110392 A1 Apr. 4, 2024

(30) Foreign Application Priority Data

Feb. 12, 2021 (IT) ..... 102021000003233

(51) Int. Cl.
*E04F 15/22* (2006.01)

(52) U.S. Cl.
CPC ..... *E04F 15/225* (2013.01)

(58) Field of Classification Search
CPC ... E04F 15/225; E04F 15/22; E04F 2290/044; E01C 3/006; E01C 13/02; E01C 13/08
See application file for complete search history.

(56) References Cited

U.S. PATENT DOCUMENTS 2,743,487 A * 5/1956 Kuhlman ..... E04F 15/225 52/480
7,162,839 B2 * 1/2007 Ohno ..... E04F 11/16 52/630

(Continued)

FOREIGN PATENT DOCUMENTS

CN 212611797 U 2/2021
CN 213867188 U 8/2021

(Continued)

OTHER PUBLICATIONS

Written Opinion of International Search Report of PCT/IT2022/050026 dated Aug. 18, 2022.

*Primary Examiner* — Christine T Cajilig
(74) *Attorney, Agent, or Firm* — FisherBroyles, LLP; Roger L. Browdy; Ronni S. Jillions

(57) ABSTRACT

An element of a damping layer including a frame which includes a plurality of through openings, a plurality of support bodies which protrude from the frame and each arranged at a respective through opening, the support bodies bridging with structural continuity two attachment regions belonging to the frame and mutually opposite with respect to the respective through opening, wherein, in a vertical plane including the longitudinal direction, each support body has between the two attachment regions an arc development with concavity facing towards the frame, wherein each support body includes two end portions each forming, in the vertical plane, together with a first face of the frame at the respective attachment region, a respective attachment angle (Continued)

facing towards the respective support body and greater than or equal to 0° and less than or equal to 45°.

11 Claims, 7 Drawing Sheets

(56) References Cited

U.S. PATENT DOCUMENTS

| | | | | |
|---|---|---|---|---|
| 10,145,062 | B2 | 12/2018 | De Vries | |
| 2004/0154254 | A1* | 8/2004 | Ohno | E04F 15/02 52/514 |
| 2009/0084054 | A1* | 4/2009 | Randjelovic | E04F 15/225 52/309.3 |
| 2014/0311074 | A1* | 10/2014 | Cormier | E04F 15/225 267/141 |
| 2015/0191878 | A1 | 7/2015 | White | |
| 2015/0345075 | A1* | 12/2015 | De Vries | D03D 1/0017 28/159 |
| 2016/0039171 | A1* | 2/2016 | Manninen | B29C 66/431 428/137 |
| 2016/0053498 | A1* | 2/2016 | Brown | E04F 15/02183 52/403.1 |
| 2017/0342667 | A1* | 11/2017 | Maritano | E01C 19/522 |
| 2024/0110392 | A1 | 4/2024 | Maritano | |
| 2024/0117573 | A1 | 4/2024 | Maritano | |

FOREIGN PATENT DOCUMENTS

| | | | |
|---|---|---|---|
| IT | TV20080100 | A1 | 2/2010 |
| WO | 2011/036600 | A2 | 3/2011 |
| WO | 2014/169328 | A1 | 10/2014 |
| WO | 2019/145985 | A1 | 8/2019 |

* cited by examiner

ELEMENT OF DAMPING LAYER FOR FLOORING AND RELATED DAMPING LAYER

TECHNICAL FILED OF THE INVENTION

The present invention relates to an element of damping layer for flooring, for example for flooring with sports use, such as synthetic turf playground, athletic racetracks, floors of sports facilities, etc. The present invention also relates to a damping layer made with such elements and to a flooring comprising the damping layer.

STATE OF THE ART

The damping layers contribute to the dynamic response of the flooring with sports use to which they are part of.

Damping layers are known which have a structure comprising a substantially planar frame and a plurality of support bodies distributed on, and protruding from, such frame. The mechanical interaction between the damping layer and the below support substrate occurs at these support bodies.

Document WO 2011/036600 A2 describes a synthetic turf flooring comprising a clay substrate, a synthetic turf mat and an intermediate elastic support structure arranged between the substrate and the synthetic turf mat, wherein the support structure extends in an undulating way, creating cantilevered portions which give a desired compliance and wherein slots are provided in the support structure for the drainage. Document WO 2019/145985 describes an element of damping layer for flooring. Document WO 2014/169328 A1 describes an interlocking assembly of flooring tiles and a damping tile supplied with the assembly.

SUMMARY OF THE INVENTION

The Applicant, in the context of the aforesaid damping layers, has noted that it is desirable to improve the known damping layers as regards the interaction between athlete (or ball) and flooring with sports use that incorporates such damping layers, in particular as regards the dynamic response to the stresses transmitted to the flooring, for example in terms of damping capacity of the stresses following the touch of the athlete on the ground (e.g., during running) or the fall of the athlete on the ground or even the ball bouncing.

The Applicant has therefore faced the problem of providing an element of damping layer for flooring (and a related damping layer), having a frame and a plurality of support bodies distributed on, and protruding from, such frame, which is able to provide a desired dynamic response to the stresses, for example in terms of high absorption capacity of the stresses.

According to the Applicant, the above problem is solved by an element of damping layer for flooring according to the attached claims and/or having the following features.

According to an aspect the invention relates to an element of damping layer for flooring comprising:

- a frame which forms a first face of said element, said frame comprising a plurality of through openings;
- a plurality of support bodies which protrude from said frame at opposite side with respect to said first face, each support body being arranged at a respective through opening of said plurality of through openings and bridging with structural continuity two attachment regions belonging to said frame and mutually opposite with respect to said respective through opening.

Preferably said two attachment regions are mutually opposite along a longitudinal direction.

Preferably in a vertical plane perpendicular to said first face and comprising the longitudinal direction, each support body has between the two attachment regions an (entirely) arc development with concavity facing towards said frame for at least part of said arc development.

Preferably each support body comprises two end portions respectively adjacent to said two attachment regions.

Preferably, in said vertical plane, each end portion of one or more support bodies forms, together with said first face of the frame at the respective attachment region, a respective attachment angle facing towards the respective support body, said attachment angle being greater than or equal to 0° and less than or equal to 45°.

According to an aspect the invention relates to a damping layer for flooring comprising a plurality of elements of damping layer according to the present invention, arranged side by side.

According to an aspect the invention relates to a flooring comprising:

- a compact substrate;
- a surface layer arranged over the substrate and
- a damping layer for flooring according to the present invention interposed between the substrate and the surface layer, wherein said first face of each element of damping layer faces towards said surface layer.

Preferably said surface layer comprises a synthetic turf mat, and further typically a granular infill.

For the purposes of defining the attachment angle, it can be considered, on said vertical plane, a straight-line tangent to a development line of the respective end portion in a point belonging to the attachment region, for example in a central point of the attachment region.

The fact that each support body has arc development with concavity facing towards the frame for at least part of the development and that the two attachment regions are mutually opposite arranged along the longitudinal direction, allows that, when the support bodies undergo a stress (typically substantially vertical), they (elastically) deform causing the mutual distancing of the respective attachment regions. In this way, the support bodies transform the vertical stress into a stretching force of the frame at least along the longitudinal direction.

The arc development of the support bodies furthermore allows to avoid localized stress accumulation points (e.g., such as edges and/or cusps) which generate weakness points of the support body.

According to the Applicant the fact that the aforesaid attachment angle is between 0° and 45° (extreme included) allows the end portion to attach to the frame with an inclination with respect to the frame itself such that the support body transmits the stress to the frame with the component parallel to the first face that prevails over the vertical component. In this way the stress undergone by the element not only causes the (elastic) deformation of the support body, but also the deformation of the frame. Consequently, the desired overall dynamic response efficiency of the elastic element is obtained. For example, the element of the present invention, thanks to the aforesaid features, allows to obtain remarkable results in terms of absorption of the stresses (e.g., result in the specific test known as "Artificial Athlete" or "Berlin Athlete"), as better described below.

In the known damping layers described in the aforesaid patent documents, in which the attachment angle is considerably greater than 45° (for example the end portion of the support body is almost vertical at the respective attachment region to the frame), the stress is instead almost vertically transferred to the frame. In other words, the stress undergone by the element substantially deforms only the support body, without involving the frame. In addition, the element (e.g., at the attachment regions) tends to stick to the substrate, thus limiting the ability to elastically respond to the stress.

"Substantially perpendicular" referred to geometric elements (such as straight lines, planes, surfaces etc.) means that these elements form an angle of 90°+/−5°.

"Substantially parallel" referred to the above geometric elements means that these elements form an angle of 0°+/−5°.

"Longitudinal", "longitudinally" and the like mean (substantially) parallel to the longitudinal direction.

"Transversal", "transversally" and the like mean (substantially) parallel to a transversal direction perpendicular to the longitudinal direction.

"Vertical", "vertically" and the like mean (substantially) perpendicular to a plane defined by the longitudinal and transversal direction.

The present invention in one or more of the aforesaid aspects can have one or more of the following preferred features.

Preferably said attachment angle is less than or equal to 30°, even more preferably less than or equal to 20° or 10°. In this way the component of the stress parallel to the first face is further predominant with respect to the vertical component.

Preferably each support body, in said vertical plane, has sinusoidal development (e.g., equal to a complete period), wherein preferably said attachment angle is equal to 0°. Such shape is particularly advantageous for the absorption of the stresses.

Preferably said frame (and said first face) develops substantially on a plane comprising the longitudinal and transversal direction. In this way it adapts to the typically planar conformation of the substrate.

Preferably said frame has a reticular structure comprising elongated elements connected to each other at nodes. The reticular structure gives lightness to the element and draining capacity, without at the same time jeopardizing its structural strength, and moreover gives elasticity to the frame in synergy with the aforesaid features.

Preferably said reticular structure is regular (i.e., with a base pattern that is invariably repeated). The regular structure favours the spatial uniformity of the dynamic response.

Preferably each node is a connection point between at least three (and more preferably no more than three) elongated elements.

Preferably each elongated element is straight (for reducing the yielding risk).

Preferably each through opening is associated to one and only one respective support body. In this way structural strength and/or the desired dynamic response to the element is provided.

Preferably said through openings are all equal to each other. Preferably said support bodies are all equal to each other. In this way the uniformity of the dynamic response of the element is favoured.

Preferably each support body is attached to said frame only at said two attachment regions (in other words, longitudinally central portions of each support body are substantially free from said frame moving along a transversal direction substantially perpendicular to the longitudinal direction). In this way the stresses exerted by the support bodies on the frame are all substantially longitudinal.

Preferably each through opening is delimited by said two attachment regions and by two respective frame portions joining said two attachment regions respectively at (transversally) opposite sides of said through opening. These frame portions are free from the respective support body. Preferably each frame portion (at least partially) comprises at least two elongated elements not mutually parallel, wherein at least one of the two elongated elements has development (at least partially) not (even substantially) parallel to said longitudinal direction. In this way, the frame portions are shaped to be able to extend, when subjected to the aforesaid longitudinal stretching force, precisely along the longitudinal direction, by (elastic) deformation of their own shape. In fact, the elongated element with non-longitudinal development in absence of stresses, in case of stretching by the support body, tends to arrange itself so as to be more aligned to the longitudinal direction, with consequent longitudinal extension of the frame portion. This feature, in synergy with the aforesaid features relating to the attachment geometries of the support bodies (which make the longitudinal component of the stress prevail) increases the participation of the frame in the elastic deformation. Consequently, the overall efficiency of dynamic response of the elastic element is improved, for example the overall absorption of stress. It is observed that in the case in which the frame has reticular structure, this longitudinal deformation is favoured.

It is observed that the two elongated element can be portions of one or more curvilinear elongated elements.

Preferably each through opening has, in plan view, a hexagonal shape. This shape is particularly suitable for obtaining the aforesaid longitudinal extension and/or it allows a high surface density of the openings.

Preferably said hexagonal shape has a longitudinal axis of symmetry and a transversal axis of symmetry.

Preferably said hexagonal shape has main development along the longitudinal direction. In this way it is possible to arrange the openings with a high linear density along the transversal direction.

Preferably each through opening is delimited by two first elongated elements with (substantially) transversal development and respectively comprising said two attachment regions (more preferably in middle position of the respective elongated element), and by two pairs of consecutive second elongated elements, each pair connecting said two first elongated elements at opposite sides of the through opening.

Preferably each first elongated element has two transversal end portions left free by the respective attachment region (in other words, the attachment region has transversal length lower than the one of the first elongated element). In this way the free portion of the first elongated element can participate to the aforesaid longitudinal extension of the respective frame portion.

Preferably said at least two elongated elements coincide with said second elongated elements.

Preferably each frame portion comprises in their entirety said at least two elongated elements.

Preferably each frame portion comprises in their entirety only said at least two elongated elements.

Preferably each of said at least two elongated elements has development (at least partially) not parallel to said longitudinal direction.

Preferably each of said at least two elongated elements has development (at least partially) not (even substantially) parallel to said transversal direction.

Preferably each frame portion further comprises a respective transversal end portion of the two first elongated elements. In this way the longitudinal extension property is improved.

Preferably said at least two elongated elements of each frame portion are mutually consecutive.

One or more of the features of the six paragraphs above enhance the longitudinal extension property of the frame portion.

Preferably said at least two elongated elements have rectilinear development and define between them (or between their prolongations) a connection angle facing towards the respective through opening. In this way, the two frame portions (or at least the respective central parts at the connection angle), following the aforesaid longitudinal extension, mutually approach along the transversal direction (and the aforesaid angle tends to increase in width). Without limiting to any theory, the Applicant believes that the aforesaid transversal approach and the consequent transversal contraction of the opening tend to compensate for the longitudinal extension, thus further facilitating the longitudinal extension of the frame portions and therefore improving the absorption of the stresses by the frame. It is observed that this effect of transversal contraction of the opening can also be obtained with one or more curvilinear elongated elements with concavity facing towards the opening (for example with an elliptical-like opening).

This transversal contraction is facilitated when each support body is attached to the frame only at the two attachment regions, and therefore does not transversely push. In one embodiment in which the support bodies have both longitudinal arms and transversal arms for attachment to the frame as described in WO 2014/169328 A1, these support bodies, following their deformation, tend to widen the opening in each direction, making the deformation of the frame harder than in the case in which the opening can contract in one direction to compensate for the extension along the perpendicular direction.

Preferably said connection angle is greater than or equal to 90°, more preferably greater than or equal to 100°, even more preferably greater than or equal to 120°, and less than or equal to 170°. These values favour the longitudinal extension of the frame portions.

Preferably each support body has in plan view a main development along said longitudinal direction (i.e., the transversal development is lower than the longitudinal one). In this way it is suitably shaped for longitudinally transferring the stresses in an efficient way.

Preferably each support body comprises a central portion longitudinally interposed between said respective end portions (said central portion being provided for the support on the substrate below). Preferably said central portions make a (preferably flat) second support face opposite to the first face. In use, the second face typically faces towards the compact substrate.

In one embodiment, the central portions of all the support bodies are tangent to a same plane. In this way the element is structurally simple.

In one alternative embodiment, said central portions of a first sub-plurality of support bodies are tangent to a first plane vertically offset from a second tangency plane of the central portions of a second sub-plurality of support bodies (more preferably complementary to said first sub-plurality). In this way, as the vertical load increases, the progressive crushing of the support bodies of the first sub-plurality causes the support bodies of the second sub-plurality to progressively contact the support surface. In this way, the dynamic response of the element is variable according to the intensity of the stresses undergone.

Preferably at least one between, or both, said end portions of the support body has/have in plan view a transversely tapered shape, at least moving (longitudinally) from the support body to the frame. In this way the overall weight is limited and moreover the torsion of the support body with respect to the frame about a substantially longitudinal axis is facilitated, which can further increase the dynamic response, e.g., in terms of absorption of the stresses.

Preferably each of one or more support bodies comprise one or more respective through openings (identical to each other), more preferably longitudinally elongated.

In this way, the weight of the element is further limited.

In one embodiment each support body comprises two respective through openings having different dimensions, more preferably having a mutually different longitudinal length. In this way, the support body is elastically deformed in a progressively increasing way starting from the respective portions having higher empty-to-full ratio (i.e., the portions comprising openings of larger dimensions) up to those with a lower empty-to-full ratio (i.e., comprising smaller openings), thus being able to obtain a dynamic response of the support body which varies according to the stresses undergone.

Preferably each of one or more support bodies comprise one or more (typically two) respective ribs, more preferably arranged on a face of the respective support body facing said frame. Preferably said one or more respective ribs develop (substantially) parallel to a main development of the respective support body. In this way the structural strength of the support bodies is increased. Experimentally, the Applicant has observed that the ribs further improve the dynamic response of the element in terms of absorption of the stresses (e.g., the result of the specific "Artificial Athlete" test is improved).

Preferably said plurality of support bodies comprises (at least) a first and a second group of support bodies, each group comprising a respective plurality of rows of support bodies, wherein the rows of the first group are interspersed with the rows of the second group along a transversal direction. Preferably the support bodies of the first group are arranged staggered with respect to the support bodies of the second group with respect to said longitudinal direction. In other words, the support bodies of the two groups have a mutual longitudinal displacement obtained by translation of the support bodies of the first group with respect to the support bodies of the other group along the longitudinal direction. In this way the support bodies are spatially distributed with respect to the frame in an advantageous way. In fact, with respect to the distribution of the support bodies of the aforesaid patent documents, which are all both longitudinally and transversely aligned (i.e., they are distributed on rows and columns perpendicular to each other), the present staggered arrangement of the support bodies allows to obtain, given the same dimensions of the support bodies, a greater surface density of the support bodies and/or a more homogeneous distribution of the support bodies, which further improves the dynamic response of the element (e.g., in terms of absorption of the stresses).

The staggered arrangement works synergistically with the aforesaid features that provide longitudinal extensibility to the frame portions, in particular with the hexagonal or elliptical-like openings, as it provides a high surface density of the openings and of the support bodies.

Preferably the support bodies of each row are all aligned to each other with respect to the transversal direction (e.g., taken a same reference point for each support body, such reference points are transversally aligned, i.e., lie all on a same longitudinal straight line). In this way the rows are compact.

Preferably said plurality of groups consists of said first and second group of support bodies, more preferably having their respective rows individually alternated. This alternated arrangement allows obtaining the desired dynamic response properties without excessively complicating the structure of the element.

Preferably support bodies belonging to different groups are arranged longitudinally staggered from each other by a longitudinal offset equal to (substantially) half of a longitudinal length of the support bodies. In other words, a substantially central portion of a support body is transversally interspersed with an attachment region of the frame. This feature works synergistically with the extension ability of the frame portions, providing the desired damping properties.

Preferably said frame (e.g., each elongated element) has a vertical thickness greater than or equal to 1 mm, more preferably greater than or equal to 2 mm, and/or less than or equal to 7 mm, more preferably less than or equal to 6 mm. Each elongated element preferably has a square section having a side length equal to said thickness. In this way the reticular structure is sturdy.

Preferably a maximum height of the element of damping layer on the vertical plane is greater than or equal to 5 mm, more preferably greater than or equal to 7 mm, and/or less than or equal to 40 mm, more preferably less than or equal to 30 mm. This height does not excessively alter the overall height of the flooring surface, although being enough to obtain the damping effect.

Preferably said element is in single piece. In this way it is simple to be produced (e.g., through a single moulding process).

Preferably said element is made of polymeric material, more preferably made of a single polymeric material, for example polypropylene.

Preferably said element is modular. In this way, the damping layer can be made by joining an appropriate number of equal modules as the surface to be covered varies.

DETAILED DESCRIPTION OF SOME EMBODIMENTS OF THE INVENTION

Figure 6:
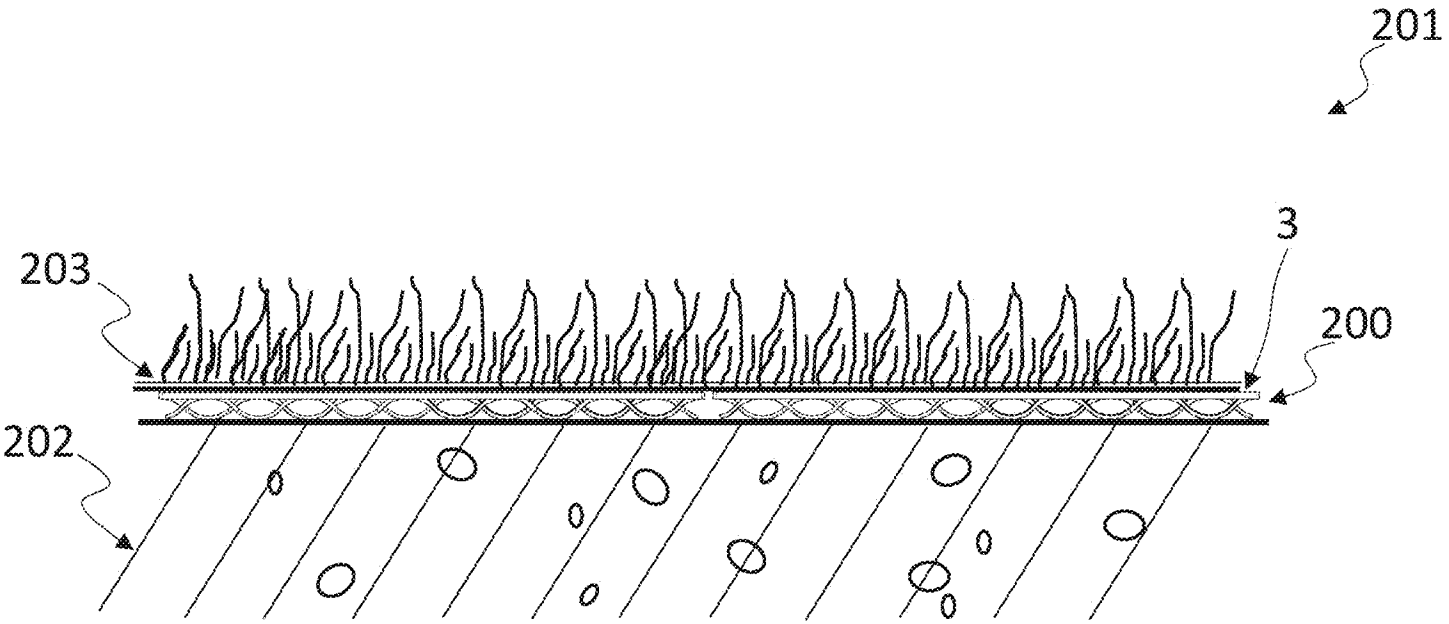
FIG. 6 shows a scheme of a flooring according to the present invention.

The features and advantages of the present invention will be further clarified by the following detailed description of some embodiments, presented by way of non-limiting example of the present invention, with reference to the attached figures. FIG. 6 exemplarily shows a flooring 201 comprising a compact substrate 202 (for example made of clay or concrete), a surface layer 203 arranged above the compact substrate and comprising a synthetic turf mat and a granular infill (not shown), and a damping layer 200 for flooring comprising a plurality of (in figure two) element 1 of damping layer arranged side by side, the damping layer being interposed between the substrate and the surface layer, wherein a flat first face 3 of the elements 1 faces towards the surface layer.

Each element 1 is exemplarily made in single piece, made of a single polymeric material, for example polypropylene, and is modular (for the purpose of a mutual interconnection with further identical elements for making the damping layer 200). The element 1 of damping layer can for example be made by an injection moulding process.

Preferably the element 1 of the damping layer is elastically deformable.

Exemplarily the element 1 comprises a frame 2 which makes the first face 3 and which develops substantially on a plane (e.g., the plane of FIG. 2) comprising a longitudinal direction 100 and a transversal direction 101 perpendicular to the longitudinal direction.

Figure 3:
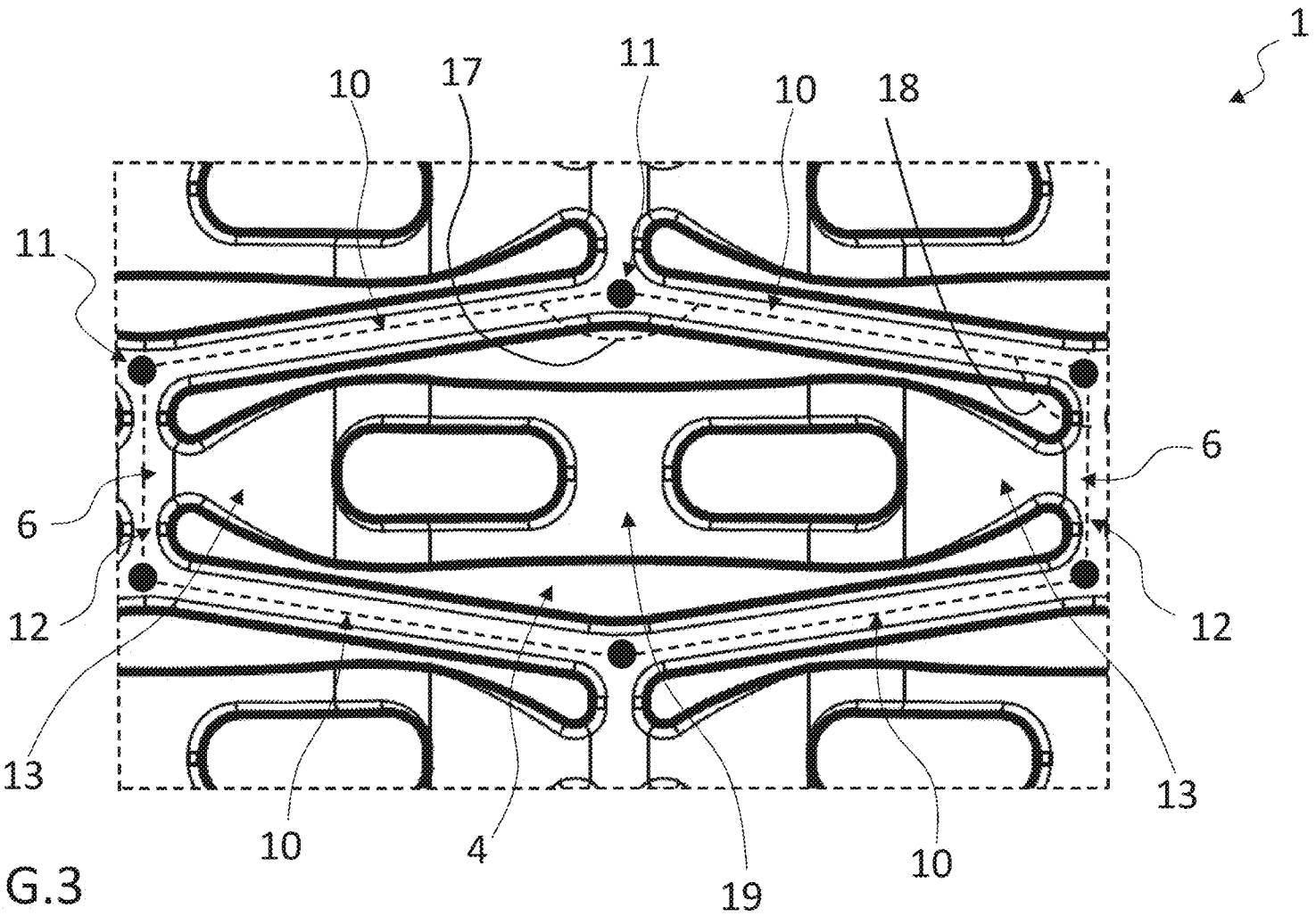
FIG. 3 shows an enlarged detail of FIG. 2.

Exemplarily the frame 2 has a regular reticular structure comprising straight elongated elements 10, 12 (see in detail FIG. 3) connected to each other at nodes 11 (symbolically identified in FIG. 3 by points), each node 11 exemplarily being a connection point of three and not more than three elongated elements 10, 12.

Exemplarily each elongated element 10, 12 has a vertical thickness S equal to about 4 mm and a square section having a side length equal to the thickness.

Exemplarily the frame 2 comprises a plurality of through openings 4 all identical to each other, having in plan view a hexagonal shape with a main development along the longitudinal direction 100 and each having a longitudinal axis of symmetry and a transversal axis of symmetry (not shown).

Exemplarily the element 1 comprises a plurality of support bodies 5 all identical to each other.

Exemplarily the support bodies 5 protrude from the frame 2 at opposite side of the frame with respect to the first face 3, each support body 5 being arranged at a respective through opening 4 of the plurality of through openings and bridging with structural continuity two attachment regions 6 belonging to the frame and mutually longitudinally opposite to the respective through opening 4.

Exemplarily each through opening 4 is associated with one and only one respective support body 5.

Exemplarily each through opening 4 is delimited by two first elongated elements 12 with transversal development and respectively comprising the two attachment regions 6 in middle position of the respective first elongated element 12, and by two pairs of consecutive second elongated elements 10, each pair connecting the two first elongated elements 12 from transversely opposite sides of the opening. Exemplarily each first elongated element 12 has two transversal end portions left free from the respective attachment region 6 (and comprised between the attachment region 6 and the nearest node 11).

Exemplarily each through opening is delimited by the attachment regions and by two frame portions joining the two attachment regions 6 respectively at transversely opposite sides of the through opening 4.

Exemplarily each frame portion is free from the respective support body and comprises (consists of) a pair of second elongated elements 10 consecutive to each other and by two end portions respectively belonging to two distinct first elongated elements 12.

Exemplarily, for each frame portion, the two second elongated elements 10 are not mutually aligned and each has development not parallel to the longitudinal direction 100. In particular, the two second elongated elements 10 of each frame portion exemplarily define between each other a connection angle 17 facing the through opening 4. Exemplarily the connection angle 17 is equal to about 160°.

For the purposes of the present invention, elongated elements having an arc development (i.e., not straight as described above) are included in the expression "development not parallel to the longitudinal direction".

Therefore, in one (not shown) embodiment each frame portion (or one or more frame portions) can comprise at least one arcuate elongated element instead of one or both the aforesaid second elongated elements 10. In this embodiment, the concavity of the arcuate elongated element is preferably faced towards the respective through opening 4, to obtain a similar technical effect (possibly with different entity) to that obtained thanks to the aforesaid connection angle 17 facing towards the through opening 4 (i.e., transversal contraction of the opening and longitudinal extension). In one further embodiment (FIG. 7*c*) each through opening (or one or more through openings) has rectangular shape.

Exemplarily, for each frame portion, each second elongated element 10 defines with an end portion of the adjacent first elongated element 12 a further connection angle 18 facing towards the opening 4 (and of smaller width than the connection angle 17), each further connection angle 18 being exemplarily equal to about 100°.

Exemplarily each support body 5 is attached to the frame 2 only at the two attachment regions 6 and has, in plan view, a main development along the longitudinal direction 100 (i.e., the transversal development is lower than the longitudinal one).

Exemplarily each support body 5 comprises two end portions 13 adjacent respectively to the two attachment regions 6 and a central portion 19 longitudinally interposed between the respective end portions 13.

Exemplarily, in a vertical plane perpendicular to the first face 3 and comprising the longitudinal direction 100 (e.g., a plane parallel to the plane of FIG. 5), each support body 5 has, between the two attachment regions 6, a sinusoidal development (comprising two respective inflection points) with concavity facing towards the frame 2 at the respective central portion 19.

Exemplarily, in the aforesaid vertical plane, each end portion 13 of each support body forms, with the first face 3 of the frame at the respective attachment region 6, a respective attachment angle 20 facing towards the respective support body 5, the attachment angle 20 being equal to 0°. In other words, each support body 5 exemplarily has a sinusoidal development which extends for an entire spatial period of the sinusoid, wherein both the respective end portions 13 are attached to the frame 2 with a null attachment angle 20 (in FIG. 5 the valleys of the sinusoid are at the attachment regions).

For the definition of the attachment angle 20 (see FIG. 5) it can be exemplarily considered, on the aforesaid vertical plane, a straight line 103 tangent to a development line 50 (indicated in broken line in FIG. 5) of the respective end portion 13 in a point P belonging to the attachment region 6 (e.g., a central point of the attachment region).

Figure 5:
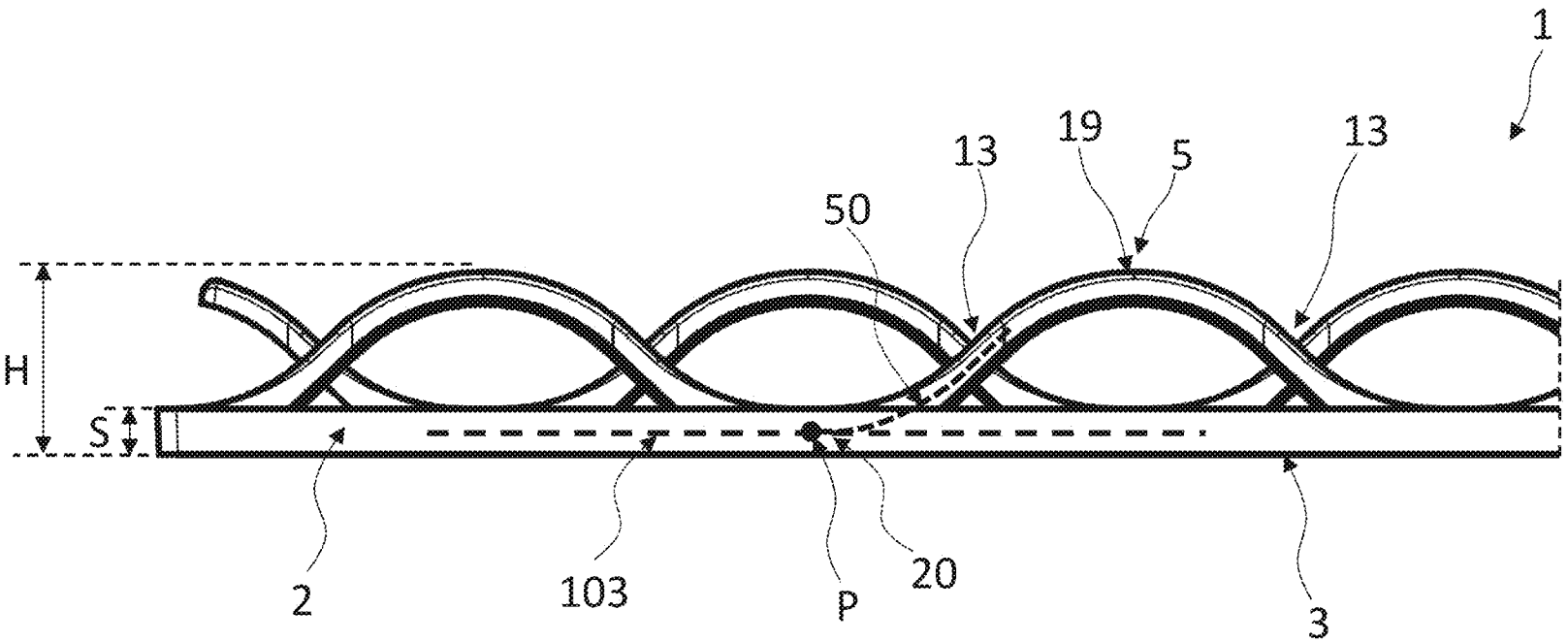
FIG. 5 shows a partial side view of the element of FIG. 1.

In FIG. 5 being the attachment angle 20 equal to 0°, the tangent line 103 is exemplarily parallel to the first face 3.

In other (not shown) embodiments, the attachment angle of each end portion can vary between 0° and 45°.

In one (not shown) embodiment the support bodies can have an arc development with concavity always facing towards the frame, e.g., circle arc concavity or parabolic segment concavity.

Exemplarily the plurality of support bodies 5 comprises a first and a second group of support bodies, each group comprising a respective plurality of rows 7, 8 of support bodies 5.

Exemplarily the rows 7 of the first group are interspersed with the rows 8 of the second group (exemplarily they are individually alternated according to an ABAB scheme wherein A indicates the rows 7 and B the rows 8) along the transversal direction 101. Exemplarily the support bodies 5 of the first group are arranged staggered with respect to the support bodies of the second group with respect to the longitudinal direction 100 and staggered by a longitudinal offset equal to half of a longitudinal length of the support bodies 5.

Exemplarily, since each through opening is associated with one and only one support body, also the through openings 4 are arranged in longitudinal rows mutually staggered by a longitudinal offset equal to half the length of the opening. The staggered arrangement is particularly synergistic with the hexagonal shape of the openings, since allows obtaining a high surface density of the openings.

Figure 1:
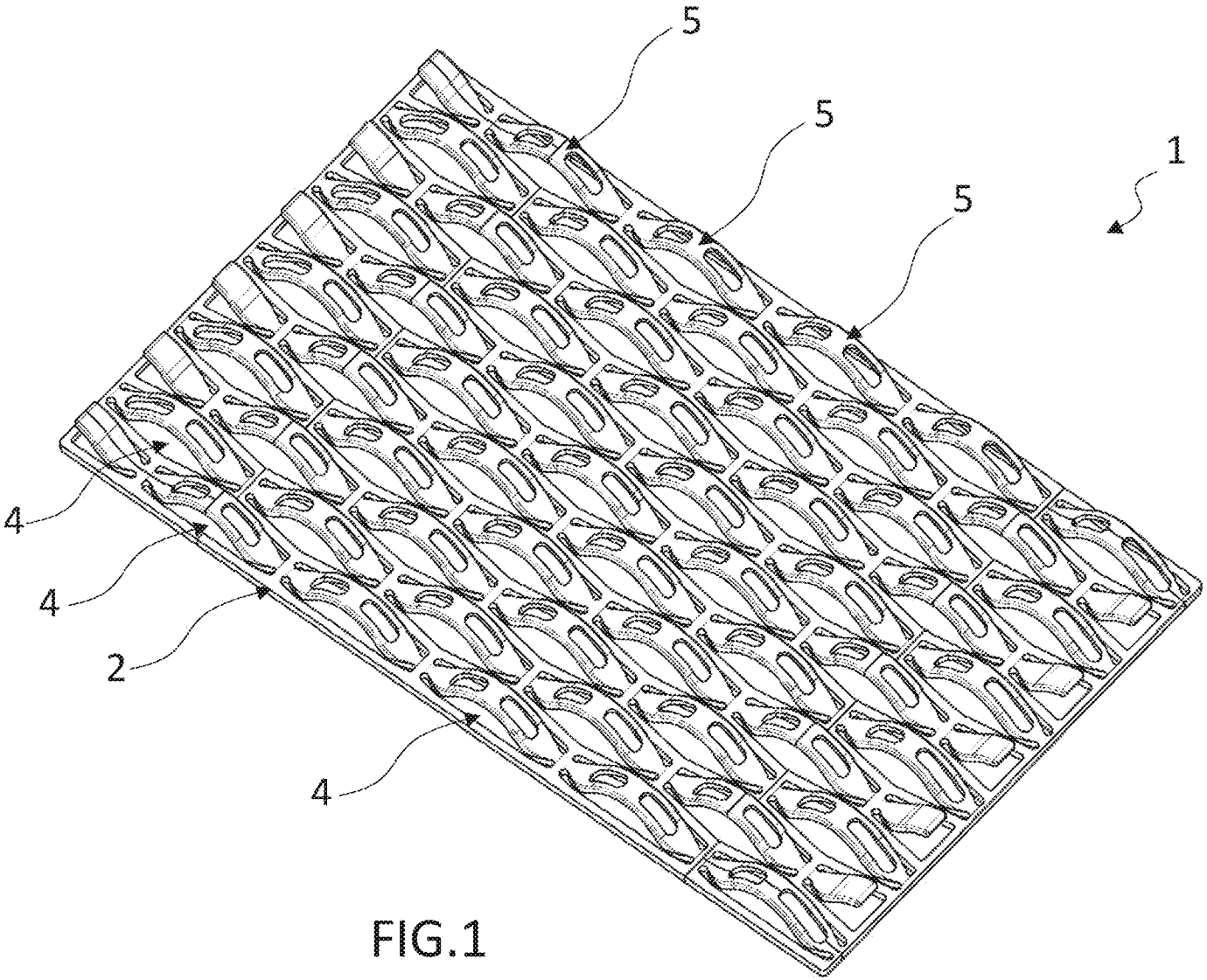
FIG. 1 shows a perspective view of an element of damping layer according to the present invention.
Figure 7A:
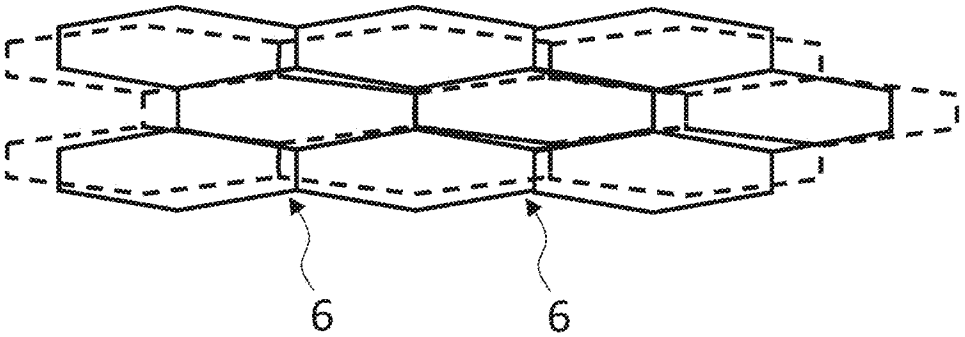
FIG. 7*a* schematically shows the reticular structure of the frame of the element of FIG. 1.
Figure 7B:
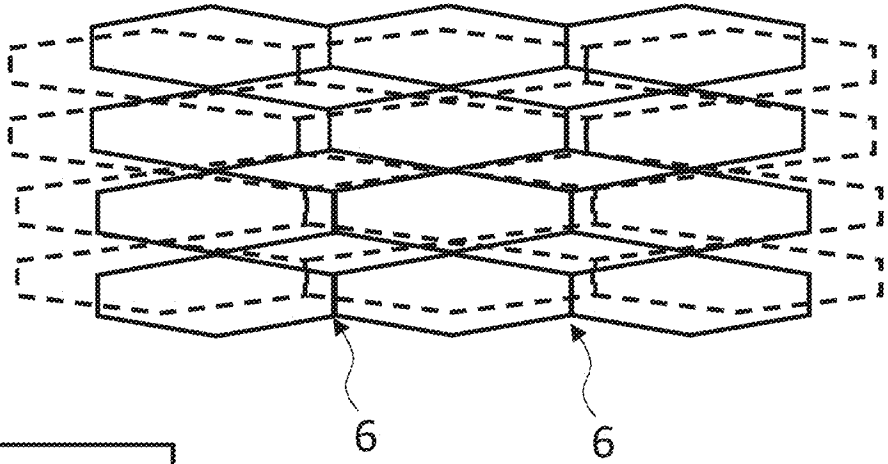
FIGS. 7*b* and 7*c* schematically show two embodiments of the reticular structures of the frame of the element.
Figure 7C:
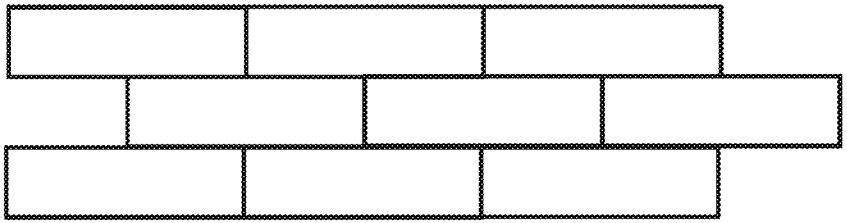

In fact, the staggered arrangement of hexagonal shapes allows to substantially reducing to zero a dead space of the frame interposed between the openings, as clear by comparing FIGS. 7*a* and 7*b* with continuous line, wherein FIG. 7*a* schematically shows the reticular structure with hexagonal openings longitudinally staggered (and aligned with respect to the transversal direction, as in the element 1 of FIG. 1) while FIG. 7*b* schematically shows an alternative reticular structure with hexagonal openings aligned with respect to the longitudinal direction (as well as the transversal one). In the case of FIG. 7*b*, between two pairs of transversely consecutive through openings there is a dead space with rhomboidal shape (which can be full or empty), which is absent in FIG. 7*a*.

The through openings of hexagonal shape and arranged longitudinally staggered further allow to obtain a more homogeneous distribution of the support bodies 5. In fact, as shown in FIG. 7*a*, each attachment region 6 (wherein the element 1 does not lie on the substrate) is transversely interspersed with a central portion of a through opening, and therefore with the central portion 19 of the support body 5 of such through opening. On the other hand, in the reticular structure of FIG. 7*b* the attachment regions 6 are aligned along transversal rows, and this causes the element 1 to have large frame areas without the support of the support bodies, these areas transversely extending for substantially an entire transversal dimension of the element 1.

Even in the (not shown) embodiment in which the through openings have a circular plan view, the arrangement of the through openings staggered with respect to the longitudinal direction allows to obtain a surface density of through openings (and therefore of support bodies) greater than an arrangement of the same through openings (i.e., with the same dimensions) aligned with each other with respect to both the longitudinal and transversal directions (as in WO 2014/169328 A1), and a more homogeneous distribution of the support bodies 5 (in a similar way as above explained for the hexagonal openings).

In the case of rectangular openings, the staggered arrangement with respect to the longitudinal direction (FIG. 7*c*), which may not affect the through openings surface density, nevertheless allows to obtain a more homogeneous distribution of the respective support bodies with respect to rectangular through openings aligned along the longitudinal and transversal directions, in a similar way as explained above in relation to the hexagonal openings.

Exemplarily the support bodies 5 of each longitudinal row 7, 8 are all mutually aligned with respect to the transversal direction 101 (i.e., they all lie on the same longitudinal straight line).

Figure 2:
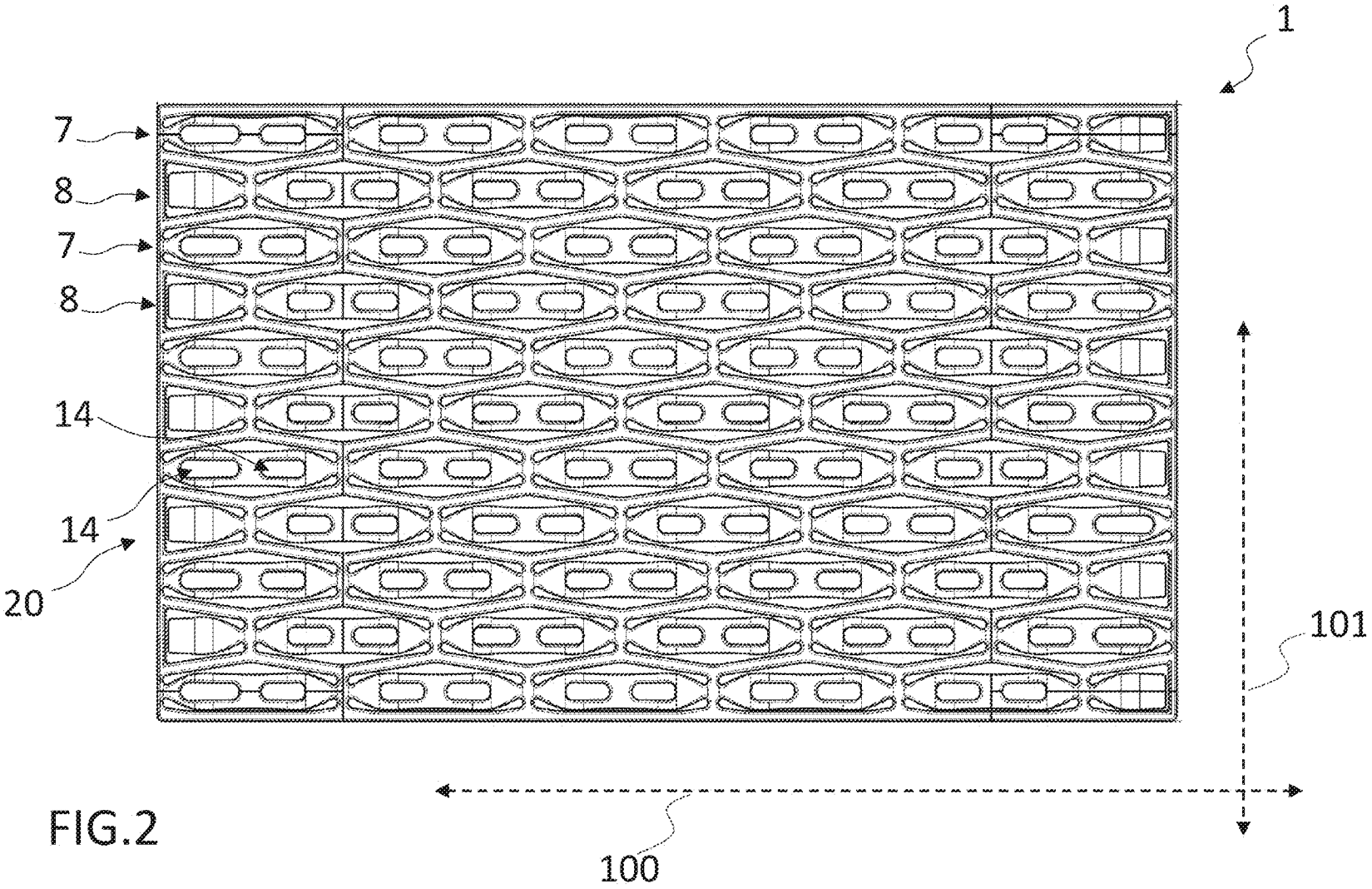
FIG. 2 shows a plan view of the element of FIG. 1.

With reference to FIG. 2, the rows 7 of the first group are arbitrarily the odd ones and the rows 8 of the second group the even ones.

In one (not shown) embodiment the rows of the first and second groups can be mutually interspersed following a pattern of the AABAAB type, or any other pattern that provides for an alternation between the rows of the two groups.

In one (not shown) embodiment the plurality of support bodies can comprise more than two groups of support bodies, each group comprising a respective plurality of rows of support bodies, wherein the rows of each group are interspersed with the rows of the remaining groups and wherein the support bodies of each group are arranged longitudinally staggered with respect to the support bodies of the remaining groups. In this embodiment, the pattern with which the rows of the groups are interspersed can be anyone, such as for example, in the case of three groups, ABCABC, or ABCBABC, etc., and the longitudinal offset of the support bodies can be, for example, equal to one third of the longitudinal length of the support bodies.

Exemplarily (FIG. 3) both the end portions 13 of each support body 5 have in plan view a transversely tapered shape longitudinally moving from the support body to the frame.

Figure 4:
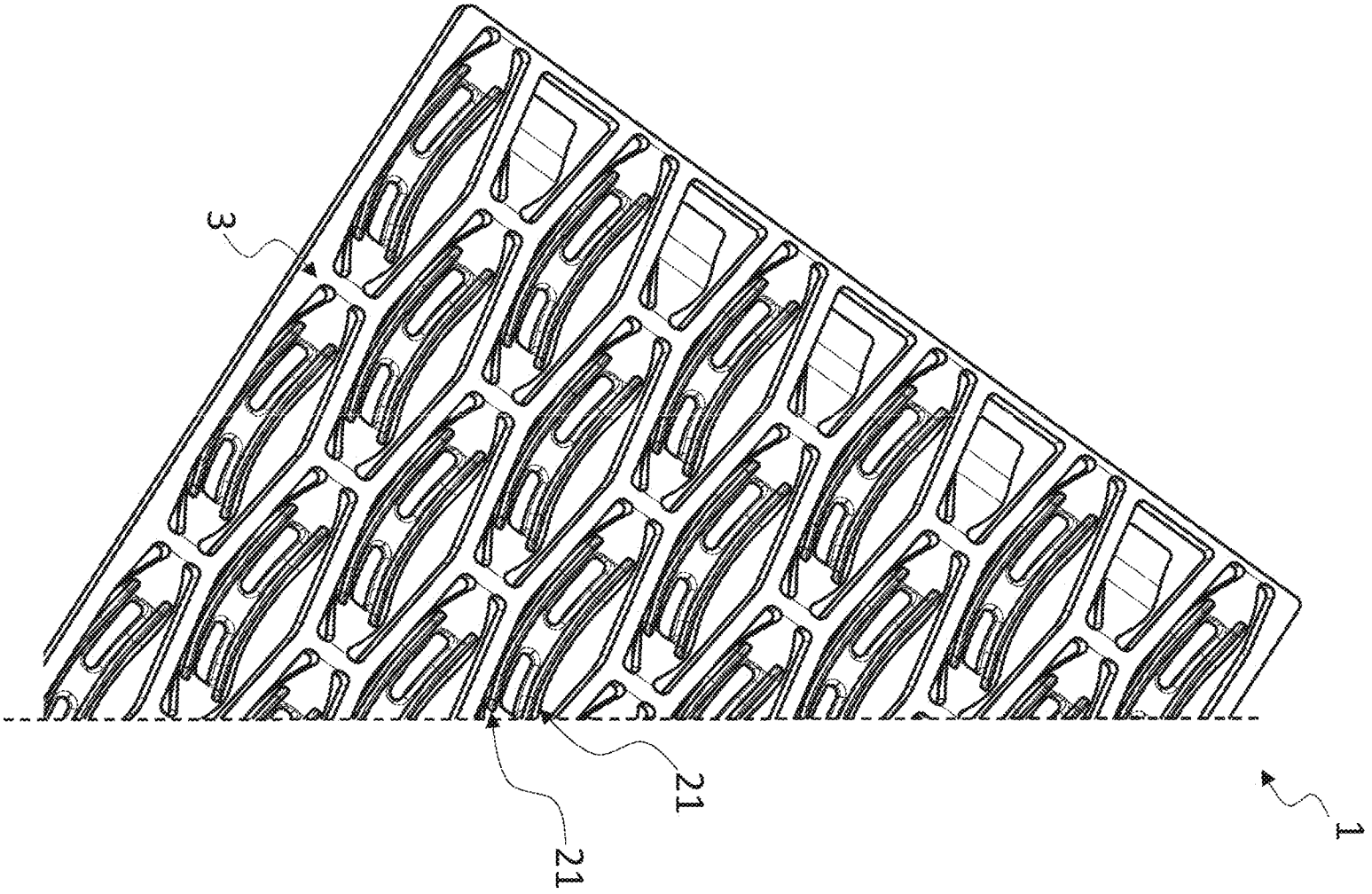
FIG. 4 shows a partial perspective view of the element of FIG. 1 from the opposite side to that of FIG. 1.

Exemplarily (FIG. 4) each support body 5 comprises two respective ribs 21 arranged on a face of the respective support body facing towards the frame 2, the ribs 21 being in relief on the surface of the support body and extending longitudinally. Exemplarily each support body 5 comprises two respective longitudinally elongated through openings 14. Exemplarily, some support bodies 5 (e.g., those arranged at the transversal edges of the element 1) have the two respective through openings having different longitudinal lengths.

As exemplarily shown in the figures, given the hexagonal shape of the through openings 4 and the plan view shape of the support bodies 5, the support bodies 5 do not occupy in plan view an entire extension of the respective opening.

In one embodiment (not shown, for example with through openings having a rectangular shape) the support bodies can occupy in plan view a substantially entire extension of the respective through opening.

Exemplarily the central portions 19 of all the support bodies are tangent to a same plane (not shown) and, in use, the central portions 19 are faced towards (e.g., in contact with) the substrate 202 (FIG. 6).

In one (not shown) embodiment the central portions of a first sub-plurality of support bodies are tangent to a first plane vertically offset with respect to a second tangency plane of the central portions of a second sub-plurality of support bodies which is complementary to the first sub-plurality.

Exemplarily a maximum height H of the element 1 on the vertical plane is equal to about 15 mm.

In the use of the element 1 of damping layer in the flooring 201, a stress coming from an athlete on the flooring 201 has typically at least a vertical component directed towards the damping layer 200. The damping layer responds by (elastic) deformation of the support bodies which, crushed by the stress of the athlete towards the substrate 202, longitudinally stretch imparting a thrust to the frame 2 at the respective attachment regions 6. This thrust has a greater longitudinal component the smaller is the attachment angle 20. Exemplarily since the attachment angle is equal to 0°, the stress is transferred to the frame substantially entirely along the longitudinal direction 100, therefore the thrust is entirely longitudinal. The frame 2, thanks to the values of attachment angle according to the present invention, is therefore involved in the (elastic) deformation of the element 1 and, in turn, is able to absorb the longitudinal stress transmitted by the support bodies by (elastic) deformation of the reticular structure, in particular at the connection angles 17 between each pair of second elongated elements 10 and possibly also at the further connection angles 18.

In fact, subject to the longitudinal thrust of the support body 5, the second elongated elements 10 (inclined with respect to the longitudinal direction 100 in absence of forces) tend to align with the longitudinal direction 100 (i.e., they tend to increase the width of the connection angle 17) by (elastic) deformation of the node 11 at the connection angle 17, rather than by (elastic) deformation distributed along the entire frame portion. In this way, a longitudinal extension of the frame portions that delimit the through opening is achieved, which allows to absorb the longitudinal thrust and therefore damping the stress exerted by the athlete.

In one (not shown) embodiment in which the frame portion is purely longitudinal (for example the opening has a rectangular plan view and the attachment region is transversely wide as the opening), for the same stretching force, the extension length of this portion is overall more limited, as requires its (elastic) elongation distributed along the entire frame portion.

Exemplarily, thanks to the fact that the connection angle 17 faces towards the respective through opening, the longitudinal extension of the frame portions is also accompanied by their transversal contraction which compensates for the longitudinal extension, further facilitating it.

As mentioned above, the reticular structure can be (elastically) deformed also at the further connection angles 18 thanks to the fact that each attachment region 6 does not entirely occupy the respective first elongated element 12, but leaves free the two transversal end portions. In the embodiment shown in FIGS. 1 to 5, these transversal end portions left free from the attachment region 6 can flex and/or generally facilitate the longitudinal extension of the frame portions (allowing for example the alignment of the second elongated element 10 to the longitudinal direction 100 by (elastic) deformation of the node 11 at the further connection angle 18).

FIGS. 7*a* and 7*b* schematically show with broken line the reticular structures in a deformed configuration as a result of the aforesaid stress. As can be seen, in both the structures, the element 1 undergoes at least locally a transversal contraction. The Applicant believes that the element 1 allows to obtain the desired dynamic response properties to the stresses in terms of absorption thanks also to the fact that the support bodies directly affected by the stress distribute this stress (e.g., following the aforesaid deformation of the frame to which all the bodies are fixed) also to the support bodies not directly involved, thus distributing the stress on a greater number of support bodies than those directly stressed by the athlete (with the foot and/or with the body).

The Applicant has subjected the element 1 of damping layer exemplarily illustrated to experimental tests conducted by the test called "Artificial Athlete" or "Berlin Athlete". The test involves the use of a special machine able to measure the performance characteristics of a surface for sports in terms of damping (KA), vertical deformation (VD) and possibly (by the so-called Advanced Artificial Athlete test) of elastic energy restitution (ER).

This test is particularly used in the evaluation of the surfaces for sports use, such as synthetic turf pitches, subject for example to EN 14904 (for indoor surfaces) and/or EN 14877 (for outdoor surfaces) which require as a result of the aforesaid test a damping value greater than 25% (to ensure optimal conditions for the athletes). The tested element of damping layer has obtained in the aforesaid Artificial Athlete test a damping result equal to about 50%/60%, significantly higher than the values obtainable with the known damping layers.

The invention claimed is:

1. An element of a damping layer for flooring, the element comprising:

a frame which forms a first face of said element, said frame comprising a plurality of through openings;

a plurality of support bodies which protrude from said frame at opposite side with respect to said first face, each support body being arranged at a respective through opening of said plurality of through openings and bridging with structural continuity two attachment regions belonging to said frame and mutually opposite with respect to said respective through opening, wherein said two attachment regions are mutually opposite along a longitudinal direction, wherein, in a vertical plane perpendicular to said first face and comprising the longitudinal direction, each support body has between the two attachment regions an arc development with concavity facing towards said frame for at least part of said arc development, wherein each support body comprises two end portions respectively adjacent to said two attachment regions, wherein, in said vertical plane, each end portion of one or more support bodies forms, together with said first face of the frame at the respective attachment region, a respective attachment angle facing towards the respective support body, said attachment angle being greater than or equal to 0° and less than or equal to 45°, and wherein the element is in single piece.

2. The element according to claim 1, wherein said attachment angle is less than or equal to 30°.

3. The element according to claim 1, wherein each support body, in said vertical plane, has sinusoidal development with said attachment angle equal to 0°.

4. The element according claim 1, wherein said frame develops substantially on a plane comprising the longitudinal direction and a transversal direction substantially perpendicular to the longitudinal direction, wherein said frame has a reticular structure comprising elongated elements connected to each other at nodes, wherein said reticular structure is regular, wherein each node is a connection point between at least three elongated elements, wherein each elongated element is straight.

5. The element according to claim 1, wherein each through opening is associated to one and only one respective support body, wherein each support body is attached to said frame only at said two attachment regions and has in plan view a main development along said longitudinal direction, wherein each of one or more support bodies comprises one or more respective ribs arranged on a face of the respective support body facing towards said frame and developing parallel to a main development of the respective support body, wherein said through openings are all equal to each other and said support bodies are all equal to each other, wherein each through opening is delimited by said two attachment regions and by two frame portions joining said two attachment regions respectively at transversely opposite sides of said through opening, wherein said frame portions are free from the respective support body, wherein each frame portion comprises at least partially at least two elongated elements not mutually parallel, and wherein at least one of the two elongated elements has development at least partially not parallel to said longitudinal direction.

6. The element according to claim 5, wherein each frame portion comprises in their entirety said at least two elongated elements, wherein each of said at least two elongated elements has development at least partially not parallel to said longitudinal direction and not parallel, not even substantially, to said transversal direction, wherein said at least two elongated elements are mutually consecutive, have rectilinear development and define between them a connection angle facing towards the respective through opening, and wherein said connection angle is greater than or equal to 90° and less than or equal to 170°.

7. The element according to claim 6, wherein each through opening has, in plan view, a hexagonal shape having a longitudinal axis of symmetry and a transversal axis of symmetry, wherein said hexagonal shape has main development along the longitudinal direction, wherein each through opening is delimited by two first elongated elements with substantially transversal development and respectively comprising said two attachment regions, and by two pairs of consecutive second elongated elements, each pair connecting said two first elongated elements at opposite sides of the through opening, wherein each first elongated element has two transversal end portions left free by the respective attachment region, wherein said at least two elongated elements coincide with said second elongated elements, and wherein each frame portion comprises in their entirety only said at least two elongated elements.

8. The element according to claim 1, wherein said plurality of support bodies comprises at least a first and a second group of support bodies, each group comprising a respective plurality of rows of support bodies, wherein the rows of the first group are interspersed with the rows of the second group along a transversal direction substantially perpendicular to said longitudinal direction, wherein the support bodies of the first group are arranged staggered with respect to the support bodies of the second group with respect to said longitudinal direction, wherein the support bodies of each row are all aligned to each other with respect to the transversal direction, and wherein the support bodies belonging to different groups are arranged longitudinally staggered from each other by a longitudinal offset equal to substantially half of a longitudinal length of the support bodies.

9. A damping layer for flooring comprising a plurality of elements of damping layer according to claim 1, arranged side by side.

10. A flooring comprising:

a compact substrate;

a surface layer arranged over the substrate and a damping layer for flooring according to claim 9 interposed between the substrate and the surface layer, wherein said first face of each element of damping layer faces towards said surface layer, wherein said surface layer comprises a synthetic turf mat and a granular infill.

11. The element according to claim 1, wherein said attachment angle is less than or equal to 20°.

* * * * *